US010398996B2

(12) United States Patent
Thompson et al.

(10) Patent No.: US 10,398,996 B2
(45) Date of Patent: Sep. 3, 2019

(54) THROTTLE EMULATOR

(71) Applicants: Terry D. Thompson, Jackson, WI (US); William B. Franks, Jordan, MN (US)

(72) Inventors: Terry D. Thompson, Jackson, WI (US); William B. Franks, Jordan, MN (US)

(73) Assignee: Wm. K. Walthers, Inc., Milwaukee, WI (US)

( * ) Notice: Subject to any disclaimer, the term of this patent is extended or adjusted under 35 U.S.C. 154(b) by 234 days.

(21) Appl. No.: 15/291,719

(22) Filed: Oct. 12, 2016

(65) Prior Publication Data

US 2017/0106304 A1 Apr. 20, 2017

Related U.S. Application Data

(60) Provisional application No. 62/241,274, filed on Oct. 14, 2015.

(51) Int. Cl.

| | |
|---|---|
| ***A63H 19/24*** | (2006.01) |
| ***A63H 29/22*** | (2006.01) |
| ***A63H 18/16*** | (2006.01) |

(52) U.S. Cl.

CPC ..... *A63H 19/24* (2013.01); *A63H 18/16* (2013.01); *A63H 29/22* (2013.01); *A63H 2019/246* (2013.01)

(58) Field of Classification Search

CPC ..... A63H 19/00; A63H 19/02; A63H 19/10; A63H 19/15; A63H 19/16; A63H 19/24

See application file for complete search history.

(56) References Cited

U.S. PATENT DOCUMENTS 6,457,681 B1 * 10/2002 Wolf ..... A63H 19/14 104/296

OTHER PUBLICATIONS

Bachmann Trains—EZ App; A Break Through in Train Control!; site last visited Jan. 3, 2017; 1 page; Blue Lightning.

CVP Products Airwire T5000 Wireless Throttle; AirWire 90, site last visited Jan. 3, 2017; 2 pages; CVP Products.

Throttles; Dlgitrax Throttles; site last visited Jan. 3, 2017; 2 pages; Dlgitrax Throttles.

ESU—Electronic Solutions Ulm GMBH & Co. KG: Moblie Control II; Mobile Control II; site last visited Jan. 3, 2017; 2 pages; ESU—electronic solutions ulm GmbH & Co. KG.

(Continued)

*Primary Examiner* — Robert J McCarry, Jr.

(74) *Attorney, Agent, or Firm* — Reinhart Boerner Van Deuren P.C.

(57) ABSTRACT

A throttle emulator system for a model vehicle includes an emulator module and a DCC interface having a connector to permit connection with a DCC command station. The DCC command station is configured to provide digital signals to control the model vehicle. The emulator module is coupled to the DCC interface and configured to transmit command and control signals to the DCC command station, via the DCC interface. The command and control signals are relayed by the DCC command station to control the model vehicle. The emulator module is further configured for wireless communication with a mobile electronic device such that a user can communicate with the emulator module to control the model vehicle through an interface on the mobile electronic device.

18 Claims, 5 Drawing Sheets

(56) References Cited

OTHER PUBLICATIONS

Lenz USA—Li USB Ethernet; Li-USB-Ethernet; site last visited Jan. 3, 2017; 1 pages; American Hobby Distributors and Lenz GmbH.
Ring Engineering Railpro; RailPro; site last visited Jan. 3, 2017; 1 pages; Ring Engineering, Inc.
Model Rectifier DCC; Tech 6 Sound / Prodigy DCC; site last visited Jan. 3, 2017; 4 pages; Brooklyn Locomotive Works.
Lenz; XPA XpressNET Phone Adaptor Digital Plus; XpressNet Phone Adapter Manual; Revised 2002; 8 pages, Art. No. 23200, Lenz GmbH.

* cited by examiner

THROTTLE EMULATOR

CROSS-REFERENCE TO RELATED PATENT APPLICATION

This patent application claims the benefit of U.S. Provisional Patent Application No. 62/241,274, filed Oct. 14, 2015, the entire teachings and disclosure of which are incorporated herein by reference thereto.

FIELD OF THE INVENTION

This invention generally relates to model railroads and devices therefor.

BACKGROUND OF THE INVENTION

Model train enthusiasts have long enjoyed constructing and operating model railroad systems in which separate track sections are joined together to form a predetermined route on which the model train can travel. Each of the separate track sections includes electrical conductors. Typically, electrical energy is supplied to the rails of the assembled track sections to energize the model train.

Model trains may be controlled digitally using digital command control (DCC), which is a standard system, defined by the National Model Railroad Association, for operating model railways. The DCC system typically employs one or more controls (throttles) and a DCC command station which, in some instances, may provide electrical power to the track and locomotive, or other devices, while pulsing the track power to transmit digital signals that control the model locomotives and any other digitally-controlled railcars or devices, including stationary devices such as turnouts and signals, for example. Alternatively, the DCC command station may control other devices which provide control signals to the model locomotives, railcars, or other devices. Typically, the DCC command station receives its instructions from a controller operated by a user. Based on the user instructions (e.g., speed, direction, lights on/off, whistle/horn, etc.), the DCC command station converts the user instructions into coded instructions that are transmitted via signals of a predetermined voltage.

Embodiments of the invention represent an advancement over the state of the art in systems that control model railways. These and other advantages of the invention, as well as additional inventive features, will be apparent from the description of the invention provided herein.

BRIEF SUMMARY OF THE INVENTION

In one aspect, embodiments of the invention provide a throttle emulator system for the remote control of a model vehicle. The throttle emulator system includes an emulator module and a DCC interface having a connector to permit connection with an input on a DCC command station. The DCC command station is configured to provide digital signals to control the model vehicle. The emulator module is coupled to the DCC interface and configured to transmit command and control signals to the input on the DCC command station, via the DCC interface, thereby emulating a DCC throttle. The command and control signals are relayed by the DCC command station to control the model vehicle. The emulator module is further configured for wireless communication with a mobile electronic device such that a user can communicate with the emulator module to remotely control the model vehicle through a user interface on the mobile electronic device. In some embodiments, the DCC interface for the DCC command station is removable and replaceable, because, currently, there is no one common input design used by all manufacturers. Specifically, the connector can be replaced with any of multiple types of connectors to accommodate multiple types of DCC command stations.

In a particular embodiment, the emulator module communicates wirelessly via Wi-Fi. In certain embodiments, the model vehicle is a model train configured to travel on a model railroad track, and the DCC command station provides the digital signals to the model train through the railroad track. The mobile electronic device may be one of a smart phone, a tablet computer, notebook computer, and a laptop computer.

In some embodiments, the emulator module is configured as a web server for the mobile electronic device, wherein the emulator module provides control elements for a user interface on the mobile electronic device, the control elements providing a means to control the model vehicle. Further, the emulator module may be configured to provide information or instructions relating to the model vehicle.

In certain embodiments, the emulator module is configured to distinguish between multiple mobile electronic devices within range of its wireless signals, such that only a desired mobile electronic device receives control elements or information from the emulator module. In a further embodiment, the emulator module is accessible to the user through the mobile electronic device after completion of a login process.

The throttle emulator system may also include a power supply module for supplying power to the emulator module. In particular embodiments, the emulator module is configured to receive video signals from the model vehicle and transmit those video signals to the mobile electronic device. In certain embodiments, the emulator module is configured to distinguish between multiple model vehicles within range of its wireless signals such that the emulator module controls only a desired model vehicle.

The emulator module may be configured to be compatible with DCC command stations using any of the current protocols such as Xpressnet, Loconet or other protocols specific to a particular system. However, the emulator module is not necessarily limited to DCC command stations using these protocols, and may be configured to include other protocols as necessary.

In another aspect, embodiments of the invention provide a throttle emulator system for a model railroad set that includes an emulator module configured to wirelessly transmit command and control signals directly to a model locomotive, model railcar, or other digitally controlled device to control operation of the model locomotive, model railcar, or device. The model locomotive, model railcar, and other device are each equipped with decoders to receive and translate the command and control signals. The emulator module is further configured for wireless communication with a mobile electronic device such that a user can communicate with the emulator module to control the model vehicle through a user interface on the mobile electronic device.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
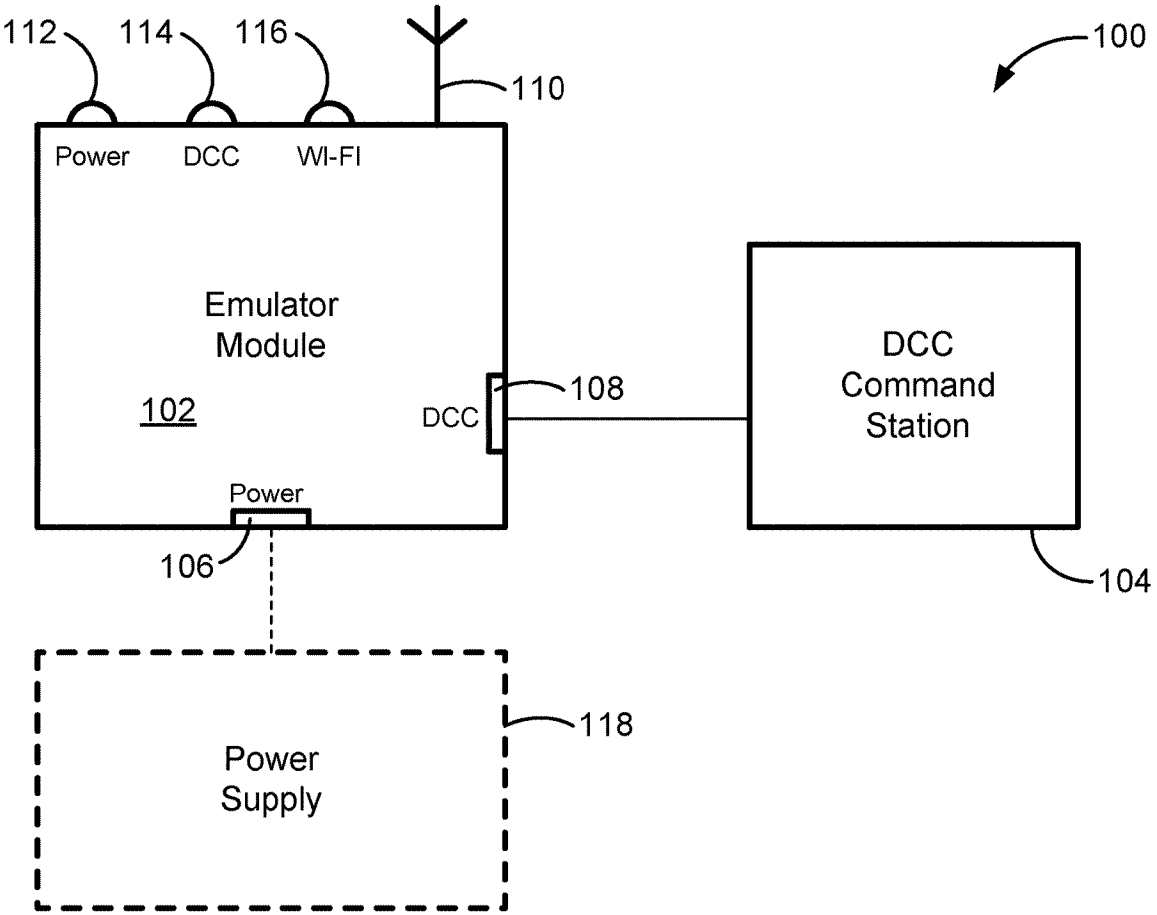
FIG. 1 is a block diagram for a throttle emulator system, according to an embodiment of the invention.

FIG. 1 is a block diagram for a throttle emulator system 100, according to an embodiment of the invention. The throttle emulator system 100 includes an emulator module 102 and a digital command control (DCC) command station 104, where the emulator module 102 communicates via wired connection with the digital command control (DCC) command station 104. The DCC command station 104 is configured to digitally control a model vehicle. For example, DCC command stations 104 are typically used to control model railroad sets, though it would not necessarily be limited to this specific application. The emulator module 102 has a power connection 106 through which external power can be provided to the emulator module 102. The emulator module 102 has a DCC connector 108 through which a wired connection to the DCC command station 104 can be established. In certain embodiments, the DCC connector 108 is removable and replaceable, such that the emulator module 102 can accommodate a variety of different DCC connectors 108 needed for different DCC command stations 104. The emulator module 102 includes an RF antenna 110 for wireless communication. In particular embodiments, the emulator module 102 includes a power indicator light 112 to provide a status of power input at power connection 106, a DCC connection indicator light 114 to provide a status for the connection to the DCC command stations 104, and a Wi-Fi indicator light 116 to indicate the status of the wireless connection.

The throttle emulator system 100 also includes an optional local power supply 118 (shown in dashed lines) to provide power to the emulator module 102 in the event that external power is not available. The power supply 118 connects to the emulator module 102 via power connection 106. In certain embodiments of the invention, the power supply 118 provides power to the emulator module 102 via a battery.

Figure 2:
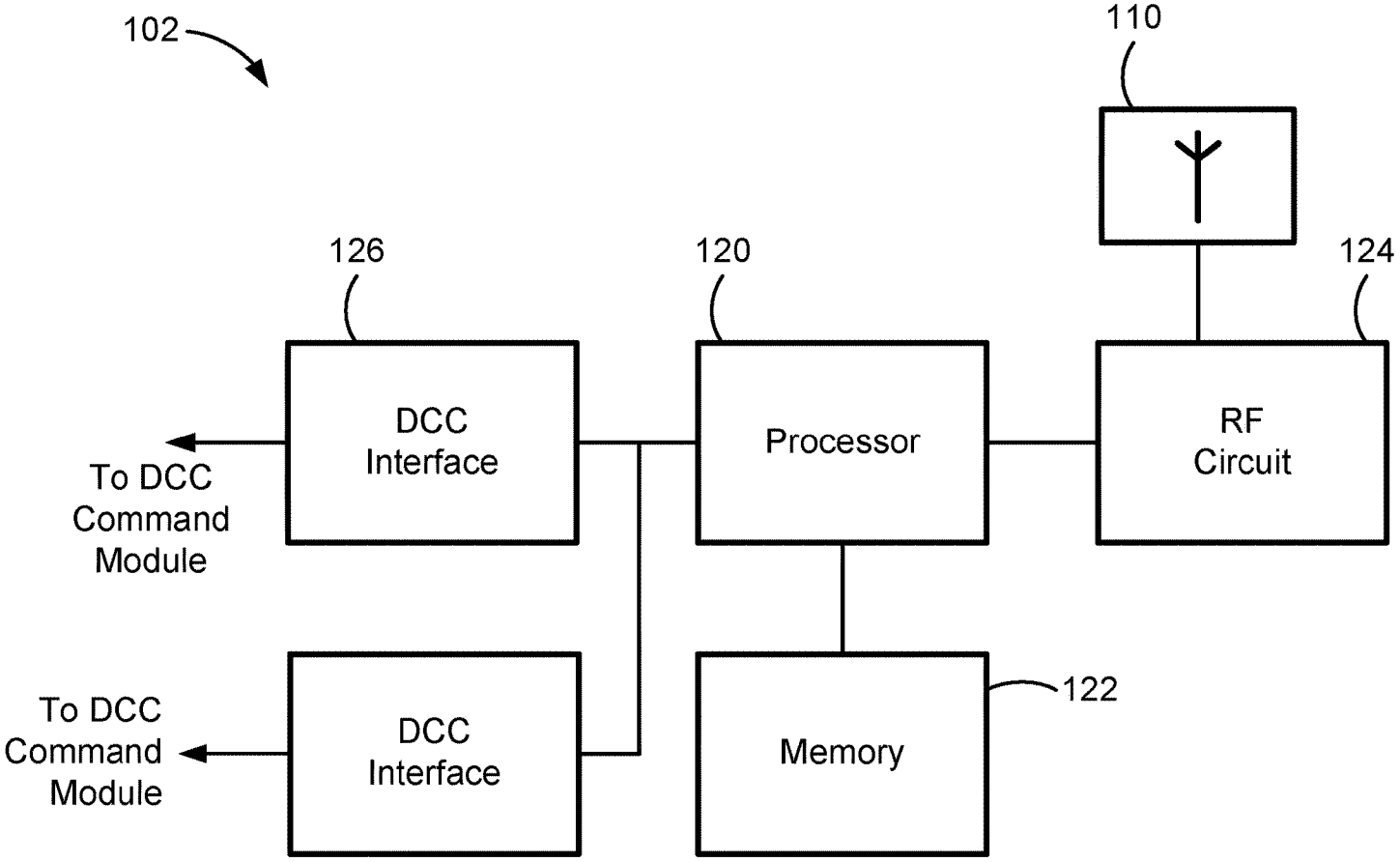
FIG. 2 is a block diagram for an emulator module, according to an embodiment of the invention.
Figure 3:
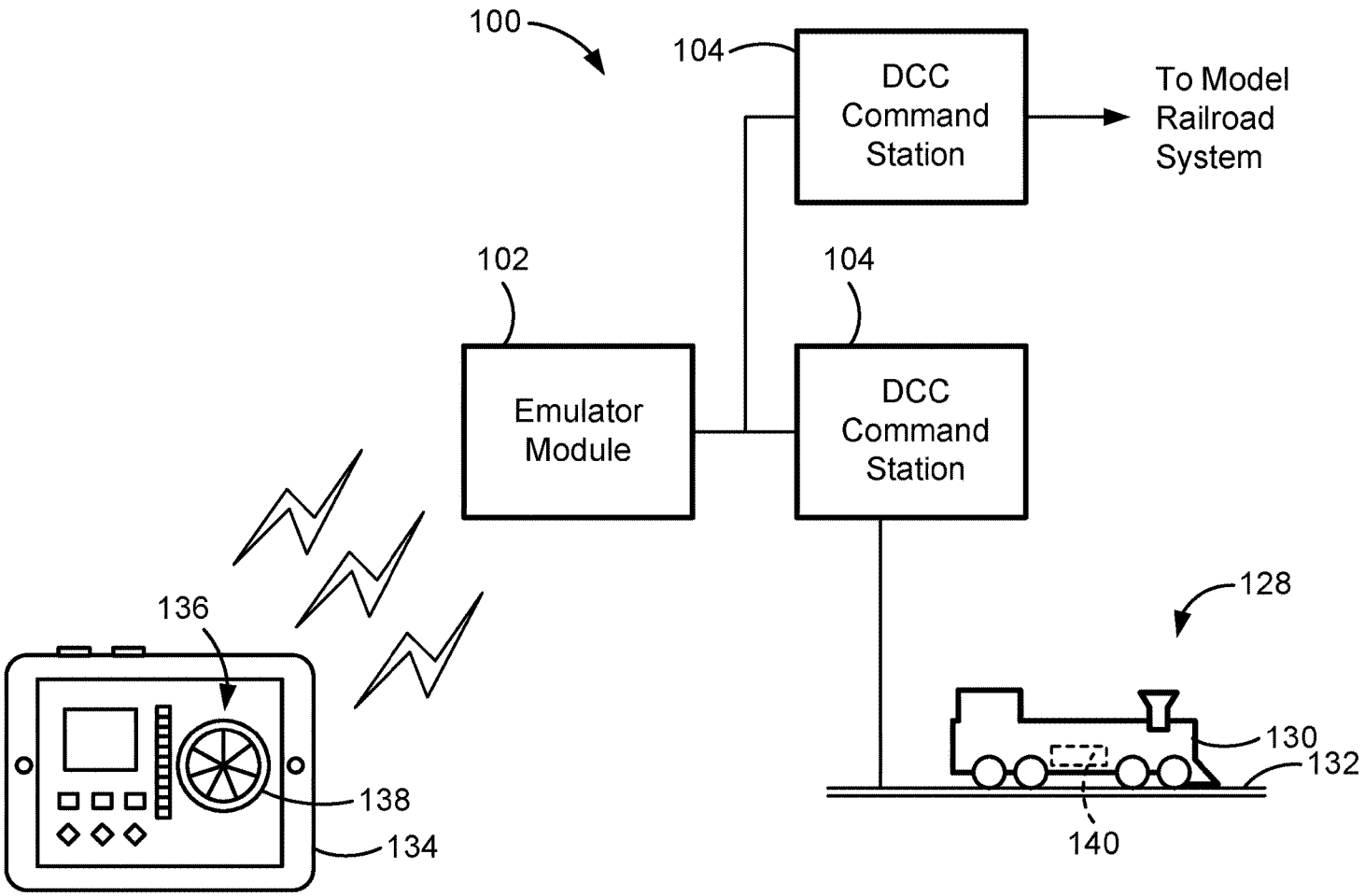
FIG. 3 is a schematic illustration showing the throttle emulator system arranged for the control of a model railroad system, in accordance with an embodiment of the invention.

FIG. 2 is a block diagram for the emulator module 102, according to an embodiment of the invention. In the embodiment shown, the emulator module 102 includes a processor 120 and electronic memory 122 for storing information related to a model vehicle or model railroad system, for example. The processor 120 is configured to communicate wirelessly through a radio frequency (RF) circuit 124 and antenna 110 coupled to the RF circuit 124. Signals from a mobile electronic device 134 (shown in FIG. 3), for example, are received by RF circuit 124, processed by processor 120, and transmitted to the DCC command station 104, via one or more DCC interface 126. The processor 120 is coupled to the DCC interface 126, which is coupled to the DCC command station 104. As can be seen from FIG. 2, the emulator module 102 may be coupled to multiple DCC interfaces 126 allowing for simultaneous connection to multiple DCC command stations 104, and the control of multiple model railroad systems FIG. 3 is an illustration showing the throttle emulator system 100 arranged to control one or more model railroad systems 128, in accordance with an embodiment of the invention. While FIG. 3 shows an embodiment of the invention in an application involving model railroads and railway vehicles, one of skill in the art will recognize that the present invention may be applied more broadly to other types of model vehicles as well. In the embodiment shown in FIG. 3, a model locomotive 130 traveling on a model track 132. For the sake of simplicity, only one model locomotive 130 is shown in the exemplary systems discussed herein, but it is understood that the present invention may be used with model railroad systems 128 having multiple model locomotives 130 and various types of railcars or other devices which could be operated and controlled by the control systems disclosed herein.

The emulator module 102 has a wired connection to the DCC command station 104, which has a wired connection to the model track 132. The model track 132 is made from a conductive material, such as metal. The DCC command station 104 may provide electrical power to the model locomotive 130 via the model track 132, or the model locomotive 130 may be powered from another external source of power delivered over the model track 132. As shown in FIG. 3, embodiments of the emulator module 102 may be simultaneously coupled to multiple DCC command stations 104. While only two DCC command stations 104 are shown in FIG. 3, the emulator module 102 may be configured to connect simultaneously to more than two DCC command stations 104.

Alternatively, the model locomotive 130 may be battery-powered. Further, the electrical power signal provided by the DCC command station 104 to the model track 132 can be modulated to provide a digital control signal for the model locomotive 130. The model locomotive 130 includes a decoder 140 to interpret and translate the modulated digital signal to operate the model locomotive 130 in accordance with the commands from the DCC command station 104.

Command signals may be provided to the DCC command station 104 from the emulator module 102, which is wirelessly connected to mobile electronic device 134. The term "mobile electronic device" as used herein includes, but is not limited to, smart phones, tablet computers, laptop computers, notebook computers, personal digital assistants, etc. In certain embodiments, wireless communication is implemented over Wi-Fi, though other wireless communication standards may be used.

In a particular embodiment of the invention, the emulator module 102 is configured as a web server for the mobile electronic device 134, wherein the emulator module 102 provides control elements 138 for a user interface 136 on the mobile electronic device 134. In this particular embodiment, the user interface 136 has various control elements 138, which may include a variety of virtual buttons, knobs, slider bars, etc. which can be manipulated (via touchscreen for example) by the user of the mobile electronic device 134 to effect control of the model locomotive 130. In this fashion, the user is able to transmit commands wirelessly to the emulator module 102 and, in turn, to the model locomotive 130 through the DCC command station 104.

In certain embodiments, the emulator module 102 is configured to distinguish between multiple model vehicles and multiple mobile electronic devices 134 within range of its wireless signals, such that the model vehicle only communicates with its owner's emulator module 102, and such that only the desired mobile electronic device 134 receives commands via the control elements 138 or information stored in the emulator module 102. This allows the use of multiple emulator modules 102 with multiple model railroad systems 128 in the same area without interference, assuring that only the desired model locomotive 128 only responds to commands from its emulator module 102.

In a further embodiment, the emulator module 102 is accessible to the user through the mobile electronic device 134 after completion of a login process. The emulator module 102 may be configured to be compatible with DCC command stations 104 using any of the current protocols such as Xpressnet, Loconet or others specific to a particular system. However, the emulator module 102 is not necessarily limited to DCC command stations 104 using these protocols, and may be configured to include other protocols as necessary.

Figure 4:
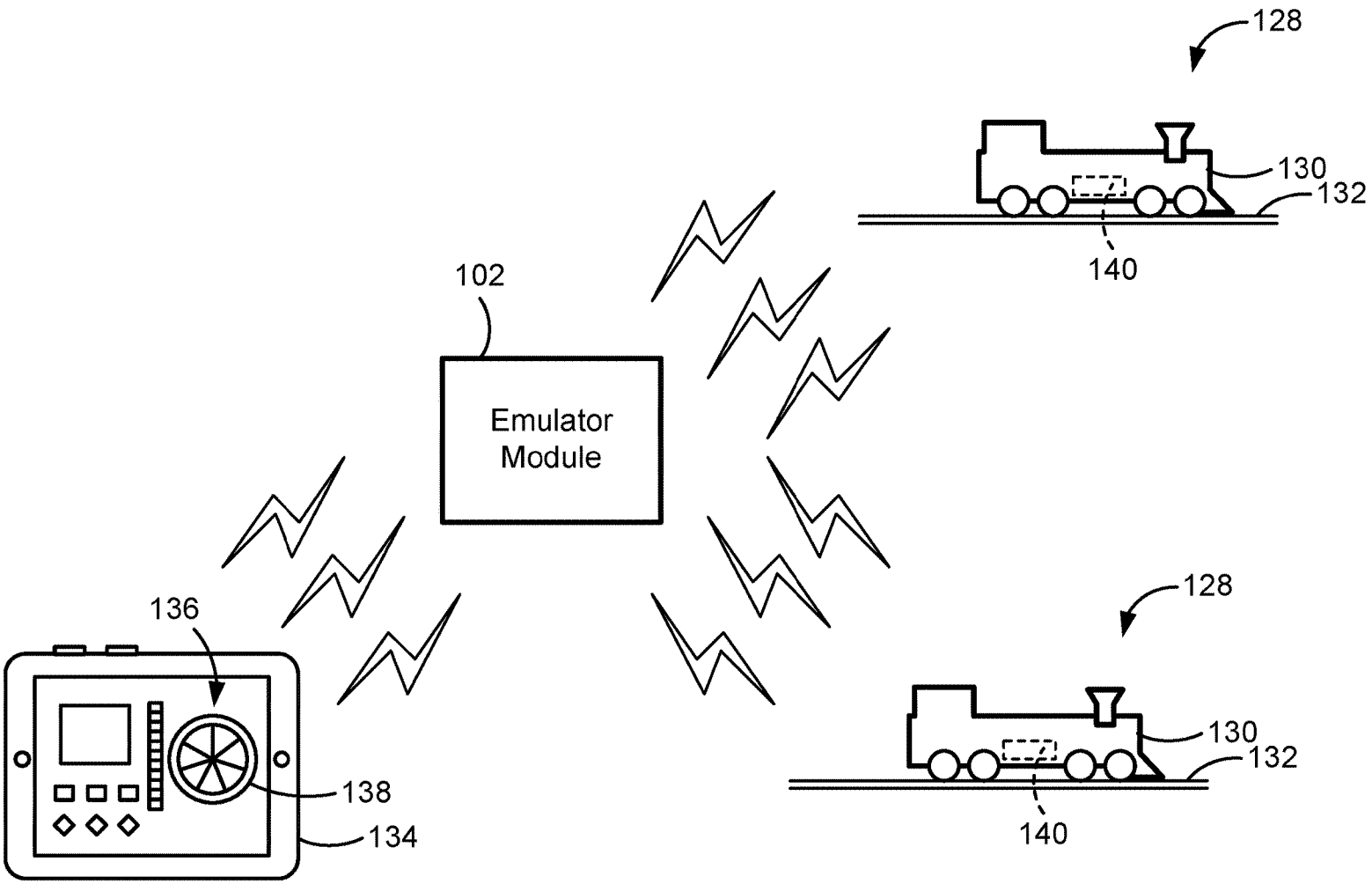
FIG. 4 is a schematic illustration showing the emulator module arranged for the control of a model railroad system, in accordance with an embodiment of the invention different from that of FIG. 3.

FIG. 4 is a schematic illustration showing the emulator module 102 configured to control one or more model railroad systems 128, in accordance with an embodiment of the invention different from that of FIG. 3. The emulator module 102 of FIG. 4 provides the same functionality as the system of FIG. 3, but without the DCC command station 104. In the embodiment of FIG. 4, the model locomotive is controlled directly via wireless signals from the emulator module 102. In other respects, the communication between the emulator module 102 and the mobile electronic device 134 are the same as described above. However, in particular embodiments, the decoder 140 would receive commands from the emulator module 102 via a Bluetooth connection, though it is envisioned that other wireless standards may be used. The decoder 140 would also be configured to transmit data for storage in the emulator module 102 system memory, or for display on the mobile electronic device 134.

Figure 5:
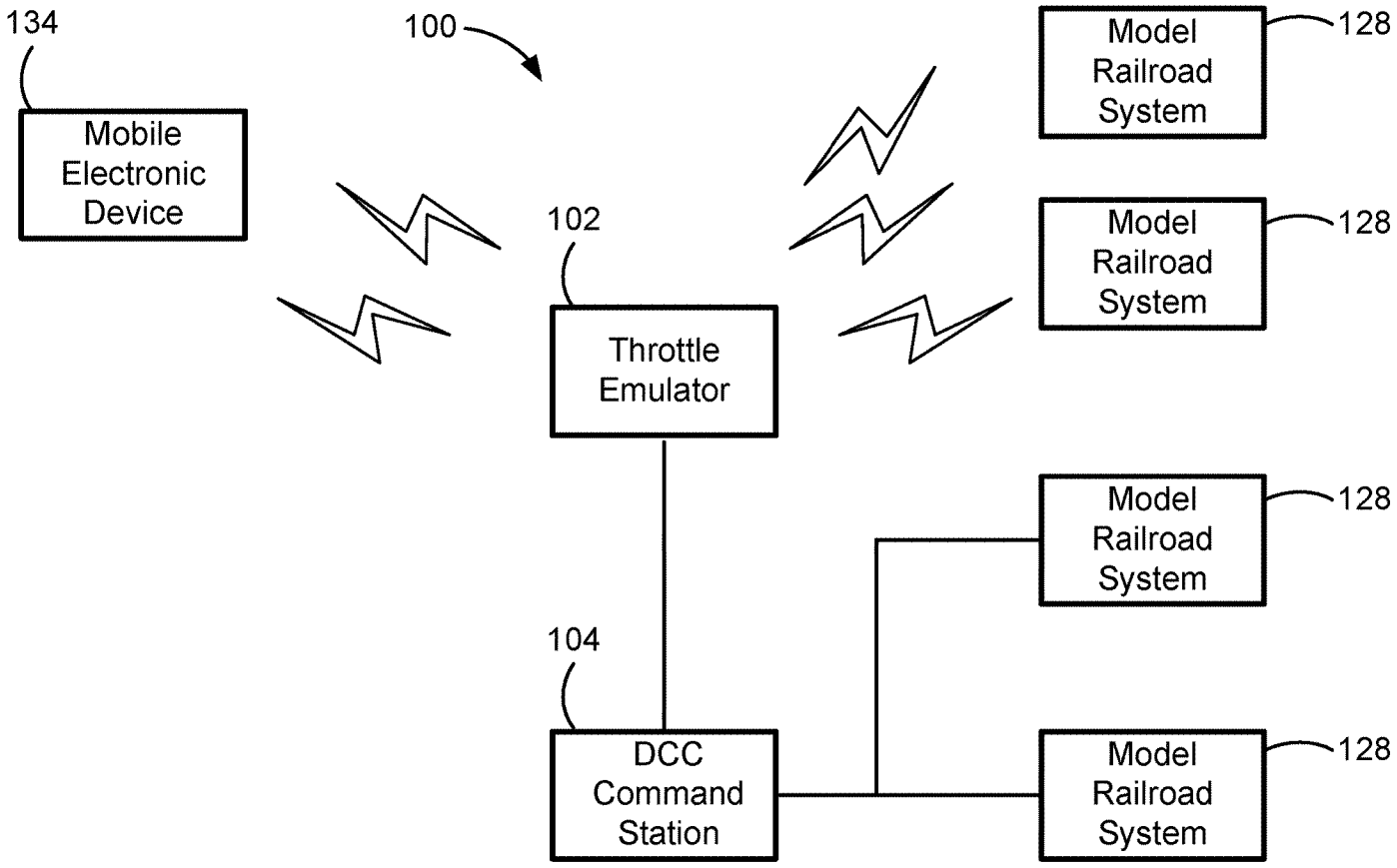
FIG. 5 is a schematic showing the throttle emulator system arranged for the control of multiple model railroad systems, in accordance with an embodiment of the invention different from that of FIG. 3 and FIG. 4.

However, it is envisioned that, in particular embodiments, the wireless communication between the mobile electronic device 134 and model locomotive 130 is two-way. For example, the user interface 136 may be configured to display video, on the mobile electronic device 134, from a camera on the model locomotive. Non-powered model train cars may also transmit video or other telemetry. Also, the mobile electronic device 134 may display data, such as speed, distance traveled, time of travel, tractive force, etc., relayed from sensors located on the model locomotive 130 or model track 132. Further, the emulator module 102 and user interface 136 may be configured to provide information or operating instructions, related to the model locomotive 130 or some other model vehicle, to the user on the mobile electronic device 134. While FIG. 4 shows the emulator module 102 communicating with two model railroad systems 128, FIG. 5 illustrates a throttle emulator system 100 and the emulator module 102 arranged to control multiple model railroad systems 128, in accordance with an embodiment of the invention. As shown in FIG. 5, the emulator module 102 may be configured to control multiple model railroad systems 128 via a direct wireless communication link while also controlling multiple different model railroad systems 128 via a wired connection to the DCC command station 104, which, in turn, transmits the control signals via a wired connection to the model railroad system 128. While FIG. 5 shows the emulator module 102 controlling two model railroad systems 128 wirelessly, and two via the wired connection to the DCC command station 104, it should be noted that the emulator module 102 is not so limited, such that more than two model railroad systems 128 may be controlled wirelessly or via wired connection to the DCC command station 104.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An emulator module for the remote control of a model vehicle, the emulator module comprising:

a DCC interface having a connector to permit connection with a DCC command station configured to provide digital signals to control the model vehicle;

a processor coupled to the DCC interface and configured to transmit command and control signals to the DCC command station, via the DCC interface, wherein the command and control signals are relayed by the DCC command station to control the model vehicle, the processor configured to operate as a web server for the mobile electronic device, wherein the processor is configured to provide control elements for a user interface on the mobile electronic device, the control elements providing a means to control the model vehicle; and an RF circuit having an antenna connected thereto, the RF circuit configured for wireless communication with a mobile electronic device such that a user can communicate with the emulator module to control the model vehicle through an interface on the mobile electronic device.

2. The emulator module of claim 1, wherein the RF circuit is configured to communicate wirelessly using Wi-Fi.

3. The emulator module of claim 1, wherein the model vehicle is a model train configured to travel on a model railroad track, and the DCC command station provides the digital signals to the model train through the railroad track.

4. The emulator module of claim 1, wherein the mobile electronic device is one of a smart phone, a tablet computer, notebook computer, and a laptop computer.

5. The emulator module of claim 1, wherein the processor is configured to provide information or instructions relating to the model vehicle.

6. The emulator module of claim 1, wherein the processor is configured to distinguish between multiple mobile electronic devices within range of its wireless signals, such that only a desired mobile electronic device receives control elements or information from the processor.

7. The emulator module of claim 1, wherein the processor is accessible to a user of the mobile electronic device after completion of a login process.

8. The emulator module of claim 1, wherein the processor is configured to receive video signals from the model vehicle, via an RF circuit, and to transmit those video signals to the mobile electronic device.

9. The emulator module of claim 1, wherein the processor is configured to distinguish between multiple model vehicles within range of its wireless signal, and to transmit control signals only to a desired model vehicle.

10. The emulator module of claim 1, further comprising a power supply module for supplying power to the emulator module.

11. The emulator module of claim 1, wherein the emulator module is compatible with DCC command stations using any one of the following protocols: Xpressnet; NCE cab bus; Loconet; and MRC.

12. The emulator module of claim 1, wherein the connector, for the DCC command station, is removable such that the connector can be replaced with multiple types of connectors to accommodate multiple types of DCC command stations.

13. A throttle emulator for a model railroad comprising:

an emulator module configured to wirelessly transmit command and control signals to a model locomotive or model railcar to control operation of the model locomotive or model railcar, wherein the model locomotive and model railcar are each equipped with decoders to receive and translate the command and control signals;

wherein the emulator module is further configured for wireless communication with a mobile electronic device such that a user can communicate with the emulator module to control the model vehicle through a user interface on the mobile electronic device; and wherein the emulator module is configured as a web server for the mobile electronic device, wherein the emulator module is further configured to provide control elements for a user interface on the mobile electronic device, the control elements providing a means to control the model locomotive and model railcar.

14. The throttle emulator of claim 13, wherein the emulator module is configured to communicate wirelessly using Wi-Fi.

15. The throttle emulator of claim 13, wherein the mobile electronic device is one of a smart phone, a tablet computer, notebook computer, and a laptop computer.

16. The throttle emulator of claim 13, wherein the emulator module is configured to provide information or instructions relating to the model locomotive and the model railcar.

17. The throttle emulator of claim 13, wherein the emulator module is configured to distinguish between multiple mobile electronic devices within range of its wireless signals, and to transmit control signals only to a desired mobile electronic device.

18. The throttle emulator of claim 13, wherein the emulator module is configured for wired communication with a DCC command station.

* * * * *